US011852445B2

(12) United States Patent
Bigelow et al.

(10) Patent No.: US 11,852,445 B2
(45) Date of Patent: Dec. 26, 2023

(54) ENTANGLING PROJECTILE SYSTEM FOR THE DISABLING OF UAV'S AND OTHER TARGETS OF INTEREST

(71) Applicant: Ascendance International, LLC, Littleton, CO (US)

(72) Inventors: Donald Bigelow, Chassell, MI (US); Cory Michalec, Lake Linden, MI (US); Joseph Garst, Highlands Ranch, CO (US)

(73) Assignee: Ascendance International, LLC, Littleton, CO (US)

( * ) Notice: Subject to any disclaimer, the term of this patent is extended or adjusted under 35 U.S.C. 154(b) by 0 days.

(21) Appl. No.: 17/865,170

(22) Filed: Jul. 14, 2022

(65) Prior Publication Data

US 2023/0020012 A1 Jan. 19, 2023

Related U.S. Application Data

(60) Provisional application No. 63/221,741, filed on Jul. 14, 2021.

(51) Int. Cl.

| | |
|---|---|
| ***F42B 12/66*** | (2006.01) |
| ***F42B 12/68*** | (2006.01) |
| ***F41H 13/00*** | (2006.01) |

(52) U.S. Cl.

CPC ..... *F41H 13/0006* (2013.01); *F42B 12/66* (2013.01)

(58) Field of Classification Search

CPC ..... F41H 13/0006; F42B 12/66; F42B 12/68
See application file for complete search history.

(56) References Cited

U.S. PATENT DOCUMENTS

| | | | | | |
|---|---|---|---|---|---|
| 39,282 | A * | 7/1863 | Ganster | F42B 12/66 | 102/504 |
| 1,067,080 | A * | 7/1913 | Torday | F42B 12/66 | 102/504 |
| 1,072,968 | A * | 9/1913 | McCreary | F42B 12/68 | 102/504 |
| 1,198,035 | A * | 9/1916 | Huntington | F42B 12/66 | 102/504 |
| 1,309,530 | A * | 7/1919 | Lamberson | F42B 12/66 | 102/504 |
| 2,184,802 | A * | 12/1939 | Milavec | F42B 12/66 | 102/504 |
| 2,251,918 | A * | 8/1941 | Dawson | F41H 11/04 | 102/504 |
| 2,296,980 | A * | 9/1942 | Carmichael | F42B 12/66 | 102/504 |
| 2,348,240 | A * | 5/1944 | Braun | F42B 25/00 | 102/393 |

(Continued)

*Primary Examiner* — Derrick R Morgan
(74) *Attorney, Agent, or Firm* — Kubota & Basol LLP

(57) ABSTRACT

The present invention surrounds a payload for use as a projectile for disabling and neutralizing Unmanned Aerial Vehicle (UAV) threats and the like. The payload uses a central projectile and one or more satellite projectiles tethered to central projectile. The satellite projectiles provide entangling elements. The satellite projectiles are configured to expand outward from the central projectile after firing to provide an entangling projectile system wherein any object or individual within the entangling zone of the projectile system can be ensnared and neutralized through the entangling action of the projectile system.

19 Claims, 9 Drawing Sheets

(56) References Cited

U.S. PATENT DOCUMENTS 2,372,383 A * 3/1945 Lee ..... F41H 13/0006 102/504
2,925,965 A * 2/1960 Pierce ..... F42C 19/095 342/67
3,803,751 A * 4/1974 Pippin, Jr. ..... A63H 27/005 446/211
3,930,448 A * 1/1976 Barber ..... F42B 12/36 116/210
3,965,611 A * 6/1976 Pippin, Jr. ..... F42B 12/60 446/211
4,327,644 A * 5/1982 Stancil ..... F42B 12/68 102/504
4,350,315 A * 9/1982 Pollin ..... F42B 10/16 244/3.1
4,799,906 A * 1/1989 Perkins, Jr. ..... F42B 12/68 102/504
5,460,155 A * 10/1995 Hobbs, II ..... F42B 12/68 124/56
5,698,815 A * 12/1997 Ragner ..... F41H 13/0006 102/504
6,381,894 B1 5/2002 Murphy
6,626,077 B1 * 9/2003 Gilbert ..... F41H 13/0006 102/504
7,314,007 B2 * 1/2008 Su ..... F41H 13/0025 361/232
7,963,278 B2 6/2011 Makowski
8,613,241 B2 12/2013 Martinez et al.
8,857,305 B1 10/2014 Tseng
9,139,304 B2 * 9/2015 Frucht ..... F42B 10/26
9,989,336 B2 6/2018 Purvis
10,036,615 B2 7/2018 Norris et al.
10,107,599 B2 10/2018 Norris et al.
10,435,153 B2 10/2019 Klein
10,634,461 B2 4/2020 Norris
10,852,114 B2 12/2020 Norris et al.
10,890,419 B2 1/2021 Norris
2013/0291710 A1 * 11/2013 Martinez ..... F42B 23/10 89/1.34
2017/0261292 A1 * 9/2017 Armstrong ..... F41H 11/02
2019/0086184 A1 3/2019 Sands
2023/0020012 A1 * 1/2023 Bigelow ..... F42B 10/28

* cited by examiner

ENTANGLING PROJECTILE SYSTEM FOR THE DISABLING OF UAV'S AND OTHER TARGETS OF INTEREST

CROSS REFERENCE TO RELATED APPLICATIONS

This application claims the benefit of U.S. Provisional Patent Application 63/221,741 entitled "ENTANGLING PROJECTILE SYSTEM FOR THE DISABLING OF UAV'S AND OTHER TARGETS OF INTEREST" filed on Jul. 14, 2021, the entire contents of which is incorporated herein by reference in its entirety for all purposes.

FIELD OF THE INVENTION

The present invention is directed to a payload for use as a projectile having a plurality of entangling elements tethered to a central projectile with a flexible line. Upon launching of the projectile, such as the firing from a barreled weapon, the entangling elements expand outward to result in an entanglement zone within which an object, or individual can be ensnared through the entangling action of the of the entangling elements.

BACKGROUND OF THE INVENTION

Until recently, the use of improvised explosive devices (IEDs) were responsible for approximately two-thirds of U.S. and Coalition casualties. Recent reports forecast that the use of weaponized drones will surpass the threat of IEDs in future conflicts. (Gouré, D. (2018, Feb. 8) [Retrieved from internet on 2018, Apr. 27] Drones will Surpass IED Threat in Future Conflicts. Retrieved from: <https://www.realcleardefense.com/articles/2018/02/08/drones_to_will_surpass_ied_threat_in_future_conflicts_113030.html>. Weaponization of drones, typically surrounds modifying a drone to allow it to carry and deliver lethal munitions. Weaponized drones have become increasingly common and pose a real and effective threat, particularly inside a range of 200 meters (656 feet) from a target.

Furthermore, the unauthorized use of drones has become problematic in environments such as search and rescue operations and emergency response efforts. Reports of drones encroaching into the airspace in the proximity of wildfires, pose a real threat to the operation of fire-fighting airplanes and helicopters in the grounding of emergency aircraft until drones are no longer encroaching in the airspace.

Unmanned Aerial Vehicles, such as CLASS I and II commercial Aerial Drone Systems, herein referred to as drones, have become prevalent threats to privacy and safety in a wide variety of use cases. Class I drone systems are categorized as having a maximum weight of under 20 lbs and operate at a nominal operating altitude of 1,200 ft above ground level, while the Class II drone systems are categorized as having a maximum weight of between 21-55 lbs and operate at altitudes under 3500 ft above ground level.

A typical UAV—particularly those which are available to consumers—are affordable, man-portable, offer relative acoustic stealth, and can carry a relatively significant payload. Commercially available drones provide flight control computers and sensors to provide stabilized flight with some degree of autonomy which mitigates the need for line-of-sight operation or continuous link to the operator. For these reasons, it is anticipated that commercially available UAVs may be used for intelligence, surveillance, and reconnaissance, but also as weapon delivery platforms for carrying explosive, chemical, radiological, and/or biological payloads.

Small commercial drones typically fly at altitudes below 200 meters (656 feet), and fly low and fast resulting in low exposure times for countermeasures to be used against them. Thus, the neutralization of a drone threat is increasingly difficult as it requires detection and subsequent action. Common threat scenarios maximize the unique flight characteristics of the drones and the ability to fly low, in near proximity to the ground—whereas detection and identification of the drones is difficult.

Due to the increasing threat of drones interfering with emergency aircraft, and the increasing weaponization of drones, there is a need for a solution for immobilizing drones within an effective range and larger impact area beyond the current capabilities presently available.

SUMMARY OF THE INVENTION

Currently available solutions propose a variety of methods to immobilize a drone mid-flight. There is an identified need a portable solution for the immobilization of a drone (interchangeably used with a UAV herein) which allows a user to immobilize a drone—preferably at a range of 100-125 meters (328-4510 feet) with kinetic countermeasures.

Many solutions have been proposed for the immobilization of a drone surrounding the use of jamming technologies, sometimes referred to as "directed energy". Jamming technologies surround the use of electromagnetic noise at radio frequencies that drones operate and transmit video at, at a power level high enough to drown out effective communication between a drone and its pilot. A problem with such solutions surrounds the effects that jamming technologies have on surrounding infrastructure which maintains safety systems. For instance, a jammer intended to immobilize a drone can have negative effects on GPS systems as well as air traffic control. (O'Donnell, Michael J. A. A. E. "To Airport Sponsor." 26 Oct. 2016. [Retrieved from internet on 2018, May 15] Retrieved from: <https://www.faa.gov/airports/airport_safety/media/UAS-Counter-Measure-Testing-letter.pdf) Furthermore, such solutions may result in a drone continuing flight blind without navigation, armed with explosives continuing toward its target due to forward momentum and falling toward its intended target with an unexploded payload. Thus, the drone, even if immobilized, poses a potential threat. In some scenarios, a jammer may result in a drone initiating a "return to home" action, in which it returns toward the operator. Although in some scenarios it is advantageous to for the initiation of such an action to allow the tracking the operator of the drone, it also poses a risk. If a drone is forced to initiate a "return to home" operation, and the operator is not found, the operator may be able to reuse the drone for a subsequent action against a target.

The use of a jamming technology is only effective if the jamming technology is active and directed toward a drone which poses a threat. Because portable jammer technologies require battery power, and because they disrupt radio communications sometimes critical for safety measures, the operational lifespan of such technologies is impractical for perpetual use. Thus, a drone that poses a threat must be safely intercepted, disabled, and disposed of prior to ceasing jamming functions. During these operations, personnel and equipment involved in interception and disabling of a jammed drone are at risk, particularly if the jamming signal is interrupted mid-intercept or mid-disposal. Furthermore, the suspension of radio communications leaves personnel vulnerable to not receive communications that may otherwise warn them of further threats.

It is an aspect of certain embodiments of the present invention to mitigate unintended negative effects which solutions such as jammers and directed energy weapons sometimes have in an urban environment. The use of a kinetic defeat strategy, involving the use of ballistic particles directed at a target, allows embodiments of the present invention to be multifunctional as a countermeasure against mobile targets and static targets while mitigating the shortfalls associated with some directed energy solutions.

Solutions such as jammers require personnel to carry additional equipment. This is both costly and encumbers the personnel's mobility and ability to respond rapidly to a threat. It is an aspect of the present invention to provide effective countermeasures to immobilize and neutralize drone threats with equipment commonly carried by law enforcement and military personnel.

Certain solutions surround the use of a drone to counter a drone which poses a threat. Drones may be used in terror attacks in both military and civilian environments. For instance, U.S. Pat. No. 9,896,221 to Kilian ("Kilian"), incorporated herein in its entirety for all purposes, is directed to a drone with a net designed to ensnare other drones. This countermeasure is both more expensive than a single anti-drone projectile of the present invention, and is limited to immobilizing a single opposing drone at a time.

In certain solutions, law enforcement and military personnel use traditional weapons—such as a shotgun—to attempt to immobilize a drone which poses a threat. However, weapons carried by law enforcement and military personnel, such as shotguns, are decreasingly effective at immobilizing a drone beyond 40 meters (131 feet) due to range limitations. A typical characteristic of shotgun shot is an approximately 2.5 cm (1 inch) in diameter of shot pattern, per meter distance to the target. Thus, the effective impact area of shotgun shot at 40 meters (131 feet), would be expected to be 100 cm (40 in) in diameter. However, the larger the area of the effective impact area, the larger the spacing between shotgun shot. It will be appreciated that the effective impact area refers to the area encompassing the points of impact of all payload elements, such as shot pellets, against a planar object perpendicular to the trajectory of the payload. Thus, a drone beyond 40 meters may not be immobilized by on-target shotgun shot due to spacing between shot. A drone which is within 40 meters (131 feet) of a target, poses a real threat. For instance, a drone travelling at speed which is immobilized by a shotgun may still travel 40 meters (131 feet) or more before coming to rest on the ground. Thus, the use of a shotgun to eliminate a threat posed by a drone may be ineffective in preventing the drone from reaching its intended target. As a result, there is a need for a solution for immobilizing a drone with an effective impact area at a range over 40 meters (131 feet), and more preferably with at a range of 200 meters (656 feet) or more.

Furthermore, with respect to traditional weapons and rounds, such as shotguns, the shot pattern of a shotgun may impact a drone but not disable it due to increasing distance between shot pellets. It is an aspect of the present invention to use connected elements to provide an impact mechanism coupled with a tangling mechanism to increase the probability of disabling flight of a UAV.

Certain existing solutions such as U.S. patent application Ser. No. 10,753,715 to Joseph Garst, et al. ("Garst"), leverage kinetic defeat strategies to disable a drone, while others such as U.S. Pat. No. 10,435,153 to Max Edward Klein ("Klein"), leverage a netting strategy to disable drones—each incorporated herein by reference in their entirety for all purposes. However, where netting strategies such as Klein fall short surround the limitations of weapon required to fire such a device as well as the effective range of the disabling device. A suitably sized round to convey a packed net requires large-caliber weapons such as a 40 mm grenade launcher or larger, or a specialized firearm. Furthermore, it will be appreciated to one skilled in the art that a net as disclosed in Klein has high aerodynamic drag, resulting in a short effective range.

It is an aspect of the present invention to provide a munitions round capable of having a suitable effective target impact area at a range of at least 100-125 meters (328-410 feet). It is a further aspect of the present invention to employ an impact and entangle disabling strategy.

Certain embodiments of the present invention comprise a central projectile having multiple satellite projectiles tethered to the central projectile with a flexible line. The central projectile is configured to spin mid-flight, causing the satellite projectiles to orbit around the central projectile. In a first scenario, the central projectile strikes a drone, the flexible lines of the satellite projectiles entangle around different aspects of the drone, resulting in the satellite projectiles impacting the drone. In a second scenario, the central projectile misses a drone but is in near proximity of the drone, wherein the orbiting action of the satellite projectiles results in the entangling of at least one flexible line around the drone, resulting in the central projectile impacting the drone, the flexible lines of the other satellite projectiles entangling around the drone, and the other satellite projectiles impacting the drone. In either scenario, there is a high likelihood of disabling and grounding the drone due to impact of projectiles, or the entanglement of the flexible lines within the propellers of the drone.

It is a further aspect of the present invention to provide an impact and entangle disabling strategy capable of being fired from common weapons such as a shotgun. In certain embodiments, a projectile system comprises a plurality of satellite projectiles that are interconnected with a central projectile by flexible lines. The flexible lines are wound around the central projectile and the satellite projectiles are placed within recesses. When placed into the recesses, the satellite projectiles do not extend past the maximum envelope of the central projectile so that the central projectile can be fired from a standardized barreled weapon such as a shotgun or 40 mm grenade launcher without impedance from the satellite projectiles. Once the projectile system is shot from the barreled weapon, an induced spin to the central projectile causes the satellite projectiles to release from the recesses and unravel the flexible lines which are wound around the central projectile. Spin can be induced from the rifling of a barreled weapon, aerodynamic features such as aerodynamic channels, a combination thereof, or through any manner appreciated by those skilled in the art. Thus, the satellite projectiles extend away from the central projectile until the extent of the flexible lines are reached. The satellite projectiles orbit around the central projectile as the central projectile spins in flight at a rapid rate. As a result, the central projectile, the flexible lines, and the satellite projectiles each provide opportunity to impact and/or entangle the drone to maximize chance of disabling and downing the drone.

Existing solutions which use pelletized shot to impact a drone are effective within narrow range from the weapons from which they are shot. The further that pelletized shot travels, the less impact it imparts upon a target, and the further apart the shot pellets spread from each other, resulting in a lower chance of impacting a target with lower kinetic energy the further the target is.

It is an aspect of the present invention to provide an anti-drone projectile system with a consistent impact area for the duration of flight from the weapons from which it is launched, to the target. Once a projectile is shot and the satellite projectiles expand outward to their extent, the projectile's effective impact zone is limited for the duration of its flight. Furthermore, even if the projectile system slows to a rate at which the kinetic impact it can impart on a target is below what is required to disable it, the entangling projectile system is still able to entangle and disable the drone. Thus, the effective range of the projectile system discussed herein is extends beyond the provided strategies currently existing.

It is an aspect of the present invention that the entangling zone of the projectile system comprises a radius equal to the distance of a satellite projectile from the longitudinal axis of the central projectile.

It is an aspect of the present invention to allow the firing of a plurality of entangling projectile systems in close succession. In certain embodiments, the entangling projectiles systems are fired in sequence with separate rounds, while in alternate embodiments a plurality of entangling projectile systems are fired with a single round.

It is an aspect of the present invention to limit self-entangling of a entangling projectile system or entanglement of nearby entangling projectile systems fired in close succession to each other. The manner in which the satellite projectiles expand radially away from the central projectile maintains the flexible line in a generally straight configuration. The radially expanding satellite projectiles thereby limiting and mitigating self-entanglement of the entangling projectile system. In certain embodiments the satellite projectiles expand radially away and maintain the flexible line in a generally straight flexible line due to centrifugal action.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary.

Additional aspects of the present invention will become more readily apparent from the detailed description, particularly when taken together with the drawings, and the claims provided herein.

DETAILED DESCRIPTION OF VARIOUS EMBODIMENTS

Figure 1:
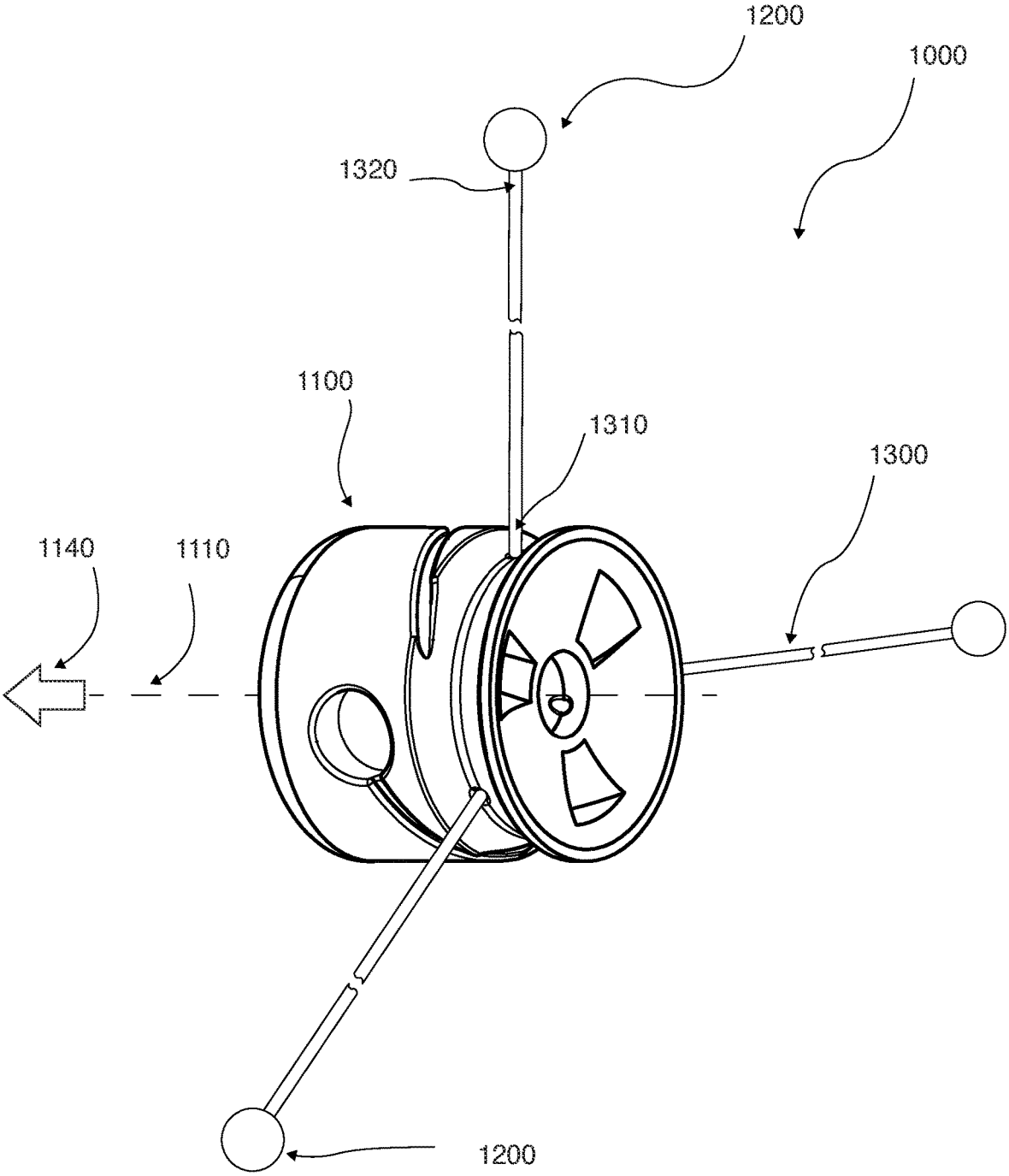
FIG. 1— A bottom perspective view of an entangling projectile system of certain embodiments in a deployed configuration FIG. 2A—A side view of a central projectile of certain embodiments FIG. 2B—A top perspective view of a central projectile of certain embodiments FIG. 2C—A bottom view of a central projectile of certain embodiments FIG. 2D—A bottom perspective view of a central projectile of certain embodiments FIG. 3A—A side view of a central projectile of certain embodiments FIG. 3B—A top perspective view of a central projectile of certain embodiments FIG. 3C—A bottom view of a central projectile of certain embodiments FIG. 3D—A bottom perspective view of a central projectile of certain embodiments FIG. 4—A side view of an entangling projectile system of certain embodiments in a stowed configuration FIG. 5A—A side view of a central projectile of certain embodiments FIG. 5B—A side section view of a central projectile of certain embodiments as shown in FIG. 4A FIG. 6A—A side view of a central projectile of certain embodiments FIG. 6B—A side section view of a central projectile of certain embodiments as shown in FIG. 5B FIG. 7—A bottom view of a central projectile of certain embodiments FIG. 8—A top perspective view of an entangling projectile system of certain embodiments in a stowed configuration FIG. 9—A top perspective view of an entangling projectile system of certain embodiments in a deployed configuration
Figure 2A:
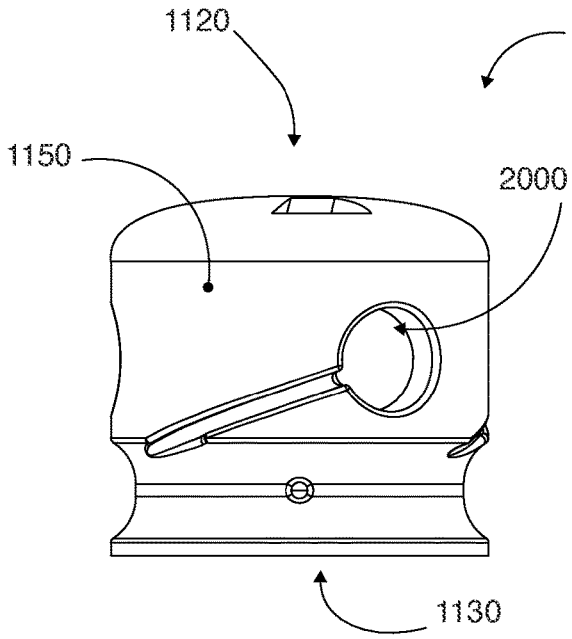
Figure 2B:
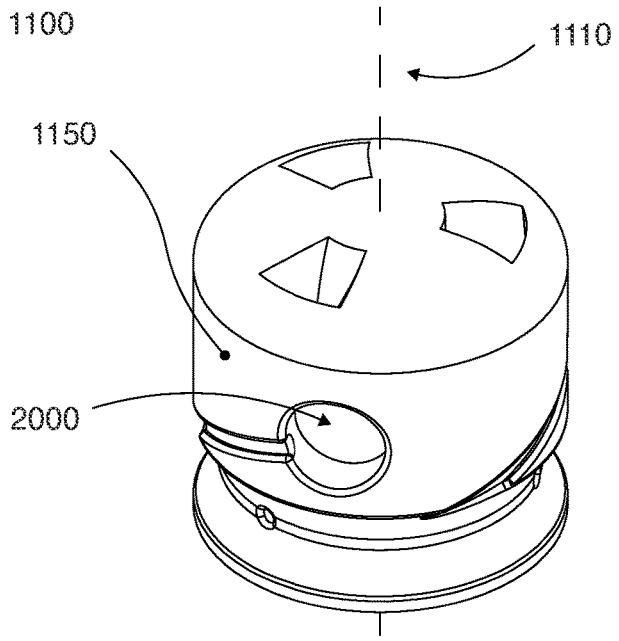
Figure 2C:
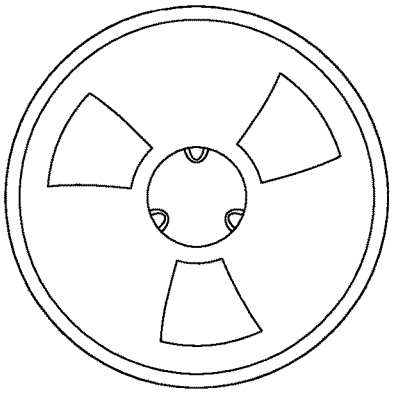
Figure 2D:
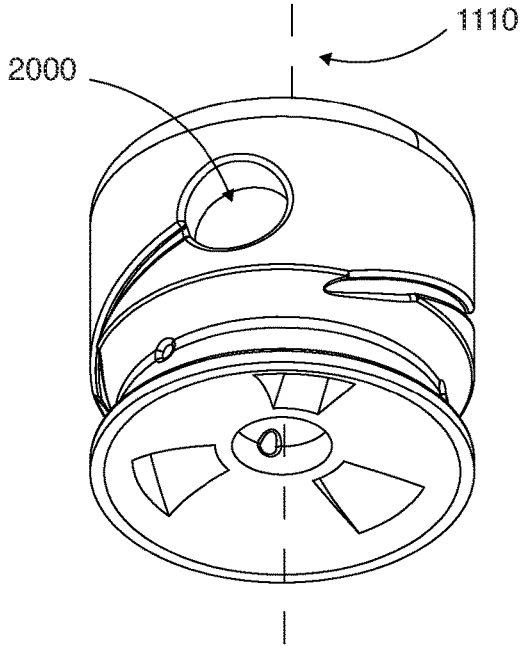
Figure 3A:
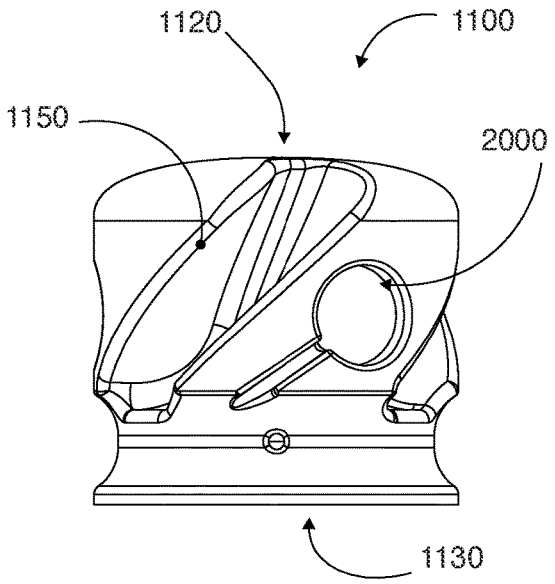
Figure 3B:
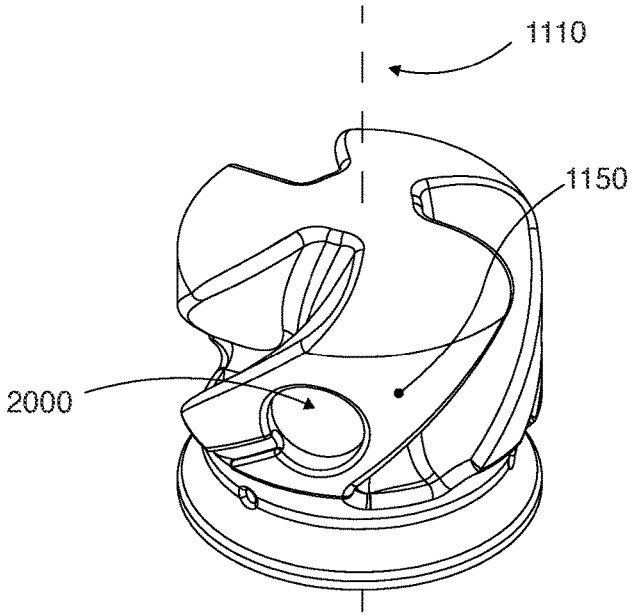
Figure 3C:
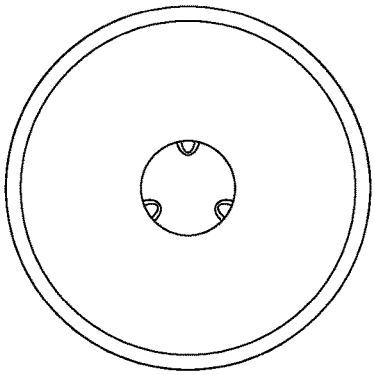
Figure 3D:
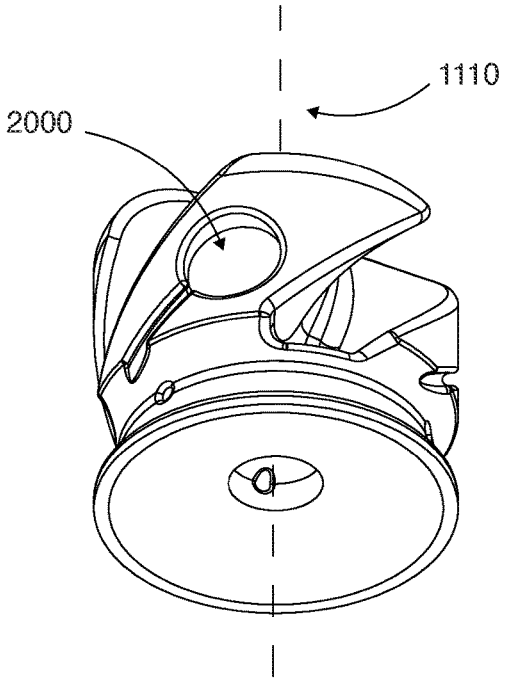

Certain embodiments of an entangling projectile system 1000 disclosed herein, shown in FIG. 1, comprise a central projectile 1100 having a plurality of satellite projectiles 1200 each interconnected to the central projectile 1100 with a flexible line 1300. A first end 1310 of the flexible line is interconnected with the central projectile 1100, and a second end 1320 of the flexible line is interconnected with a satellite projectile 1200. Certain embodiments comprise three satellite projectiles 1200, but are not limited thereto. The satellite projectiles 1200 are configured to orbit or rotate around the central projectile 1100 at the extents of the flexible lines 1300 after leaving the barrel of a weapon from which it is fired or other means of launching.

The central projectile 1100 of certain embodiments, shown in FIG. 1-FIG. 3D comprises a longitudinal axis 1110 which extends from a forward aspect 1120 of the central projectile, to a rearward aspect 1130 of the central projectile. The central projectile 1100 of certain embodiments comprises a cylindrical shape as shown, but other shapes configured to be fired from a barreled weapon are within the spirit and scope of the present invention. The longitudinal axis 1110 is parallel with the intended direction 1140 of travel of the central projectile, and the satellite projectiles 1200 are typically configured to rotate about the longitudinal axis 1110, but are not limited thereto within the spirit and scope of the present invention.

Figure 4:
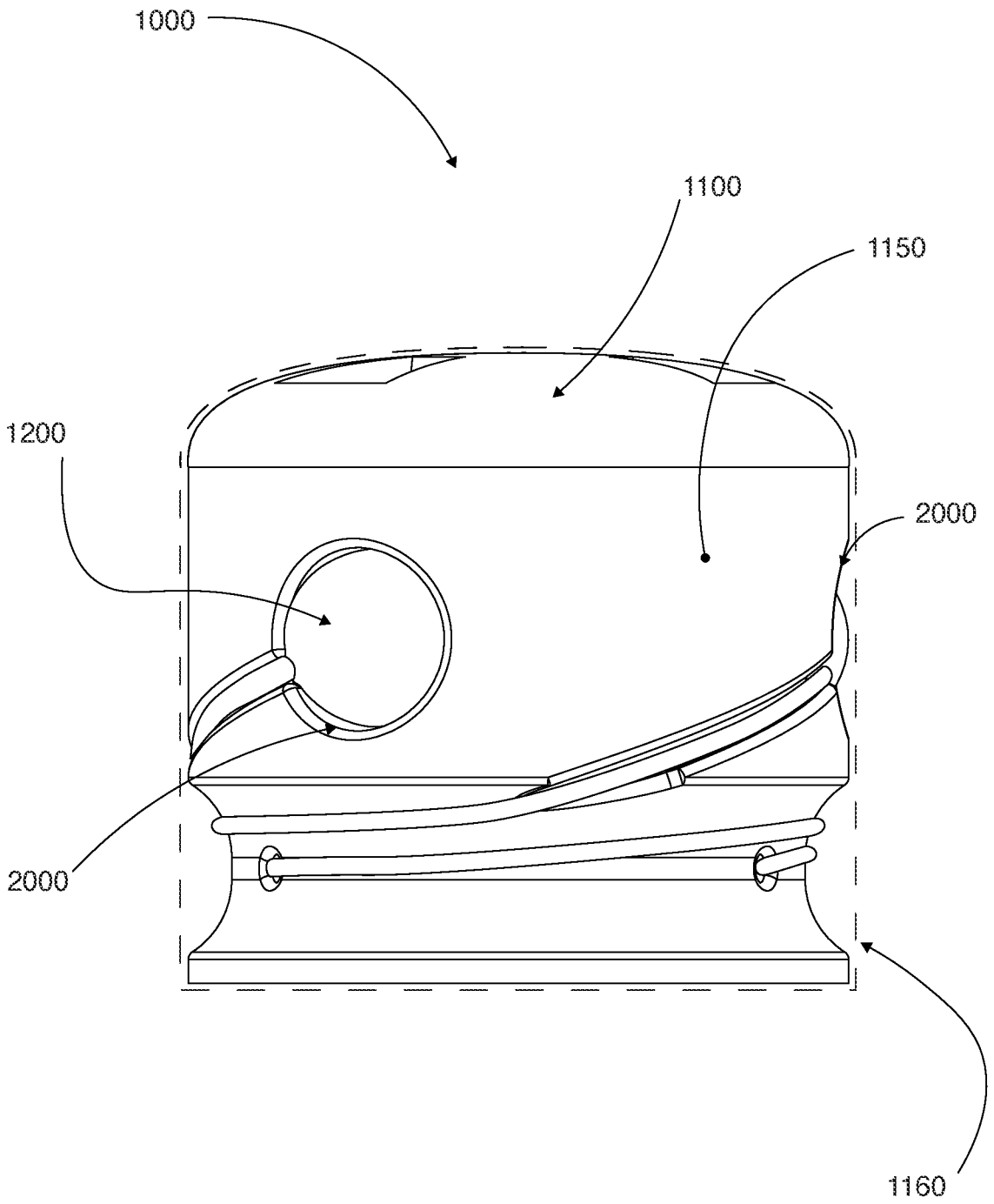

In certain embodiments, referencing FIG. 1-FIG. 3D, the central projectile 1100 comprises a plurality of recesses 2000 in an external surface 1150 of the central projectile. The recesses 2000 are configured to have the same shape as the satellite projectiles 1200 (FIG. 1), and the recesses are configured to receive satellite projectiles 1200 therein. In certain embodiments, the recesses 2000 are configured to receive the satellite projectiles 1200 wherein the satellite projectiles 1200 do not exceed a maximum envelope 1160 of the central projectile when the satellite projectiles 1200 are held within the recesses 2000. For instance, FIG. 4 shows certain embodiments with the projectile system in a stowed configuration wherein the satellite projectiles 1200 are head within the recesses 2000. In certain embodiments, the satellite projectiles comprise a spherical or spherical dome shape wherein a spherical-dome portion of the satellite projectile is configured to have a cylindrical segment portion configured to not exceed the maximum envelope 1600 of a cylindrically shaped central projectile 1100. By matching or not exceeding the maximum envelope 1160 of the central projectile, the entangling projectile system 1000 maintains the ability to be fired from a barreled weapon.

Figure 5B:
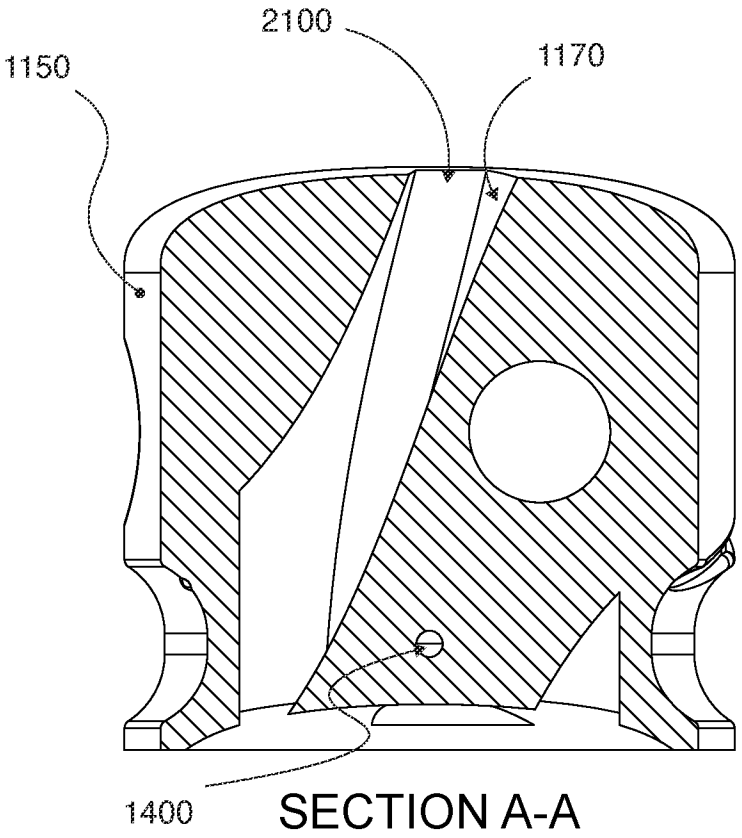
Figure 5A:
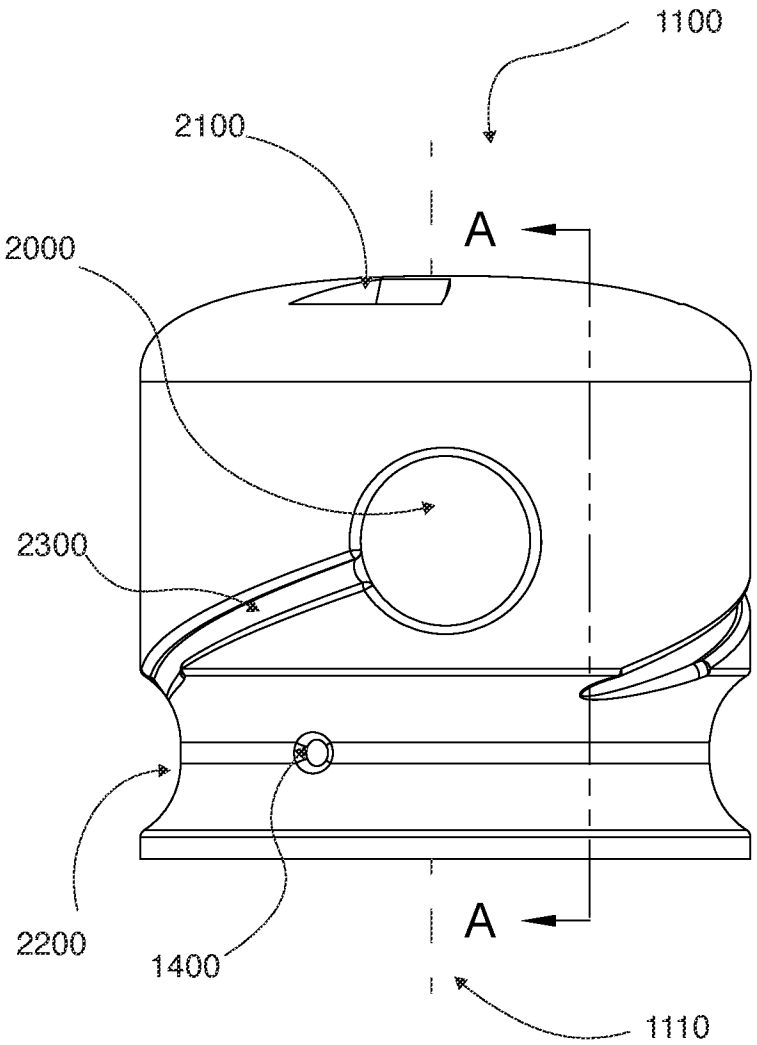
Figure 6B:
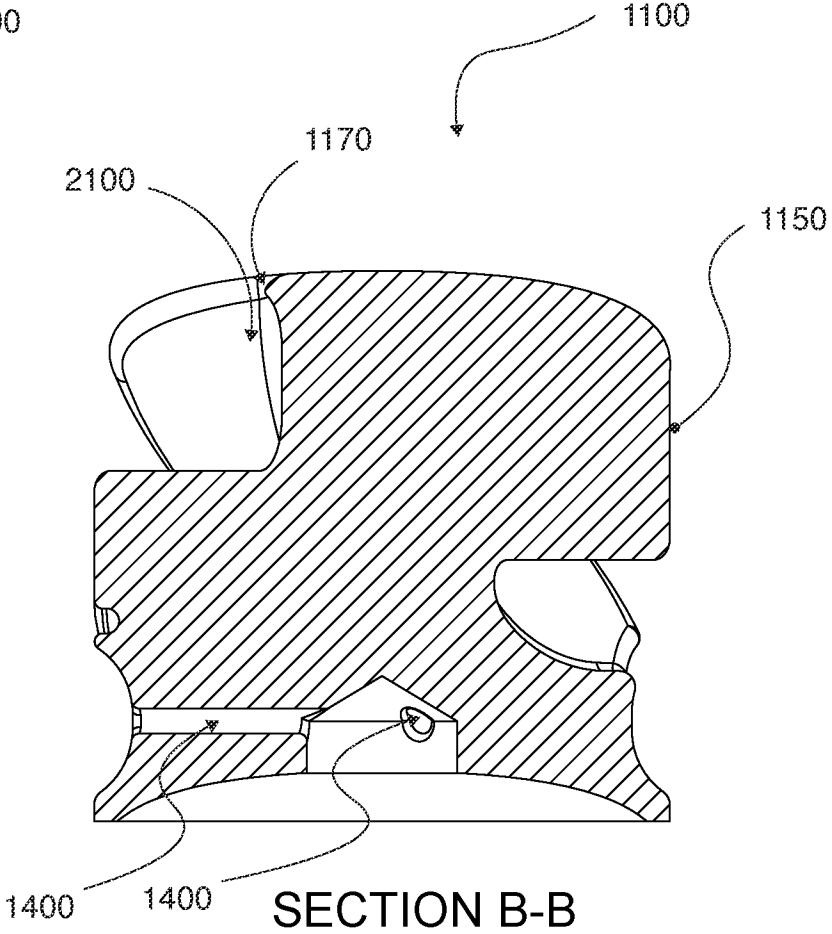
Figure 6A:
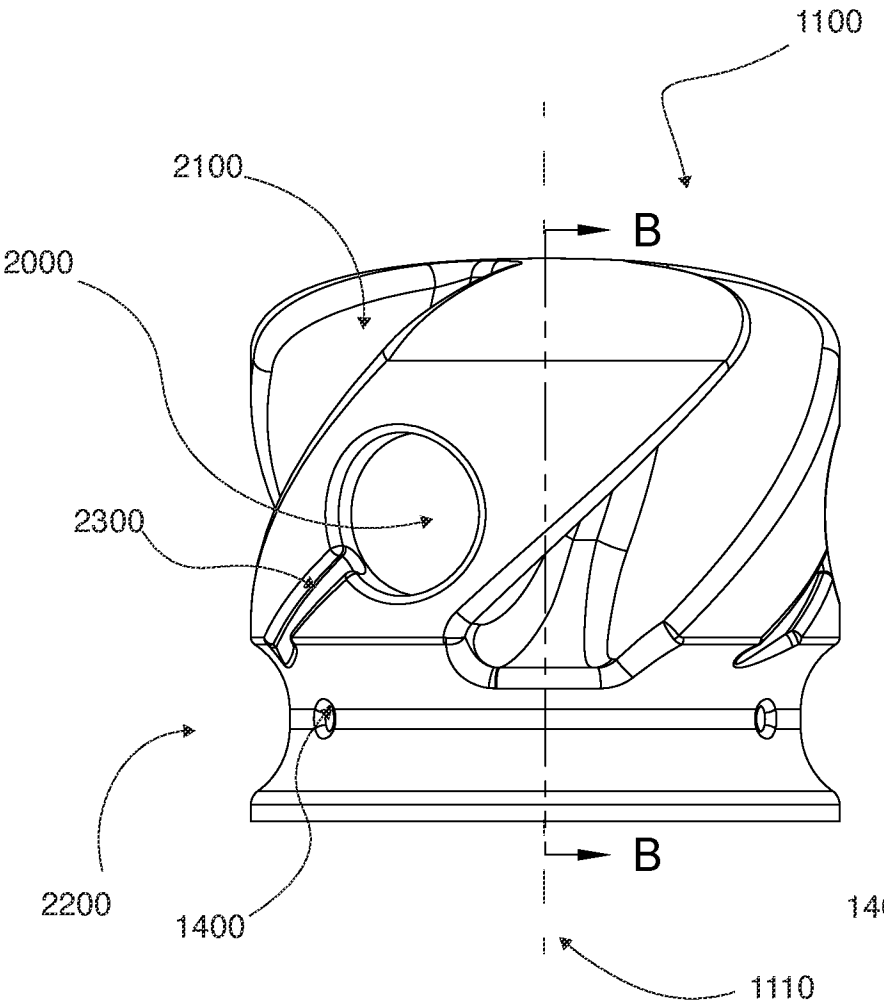
Figure 7:
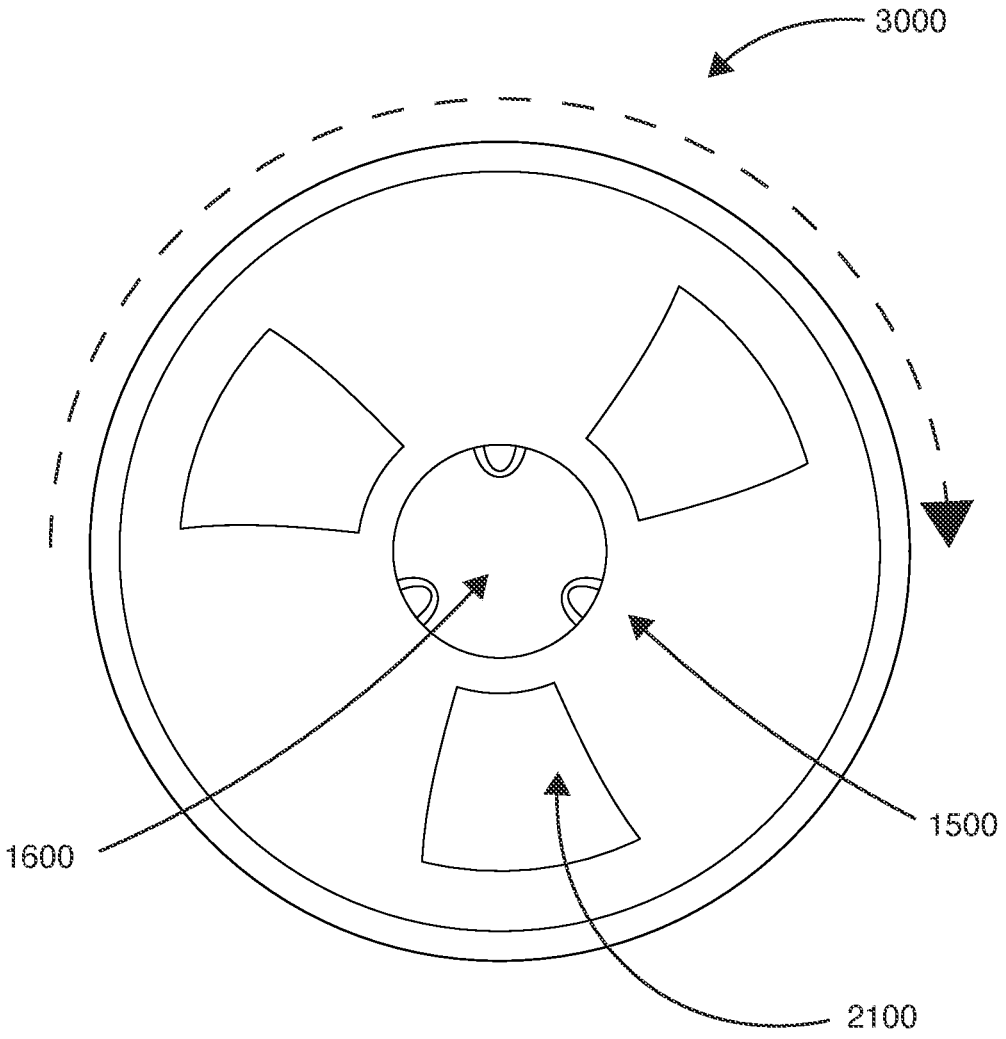

In certain embodiments, as shown in FIG. 5A-FIG. 7, a central projectile 1100 comprises a plurality of aerodynamic channels 2100 in the central projectile wherein the aerodynamic channels 2100 are configured to induce spin to the central projectile in a first rotational direction 3000 while in flight. The aerodynamic channels 2100 of certain embodiments have a helical path around the longitudinal axis 1110. In certain embodiments as shown in FIG. 5A-FIG. 5B, the aerodynamic channels extend from a medial portion 1170 of the central projectile, offset from the longitudinal axis 1110, and extend outward toward the external surface 1150 of the central projectile, but not through the external surface 1150 of the central projectile. In alternate embodiments as shown in FIG. 6A-FIG. 6B, the aerodynamic channels 2100 extend from a medial portion 1170 of the central projectile, offset from the longitudinal axis 1110, and extend through the external surface 1150 of the central projectile. In the embodiments shown, the aerodynamic channels are configured to induce spin in a clockwise direction. However, aerodynamic channels which induce a counterclockwise spin are within the spirit and scope of the present invention. It will be appreciated by those skilled in the art that rotational directions discussed within this application are based on a view taken from a rearward aspect with the projectile system travelling away from the viewer as shown in FIG. 7.

Figure 8:
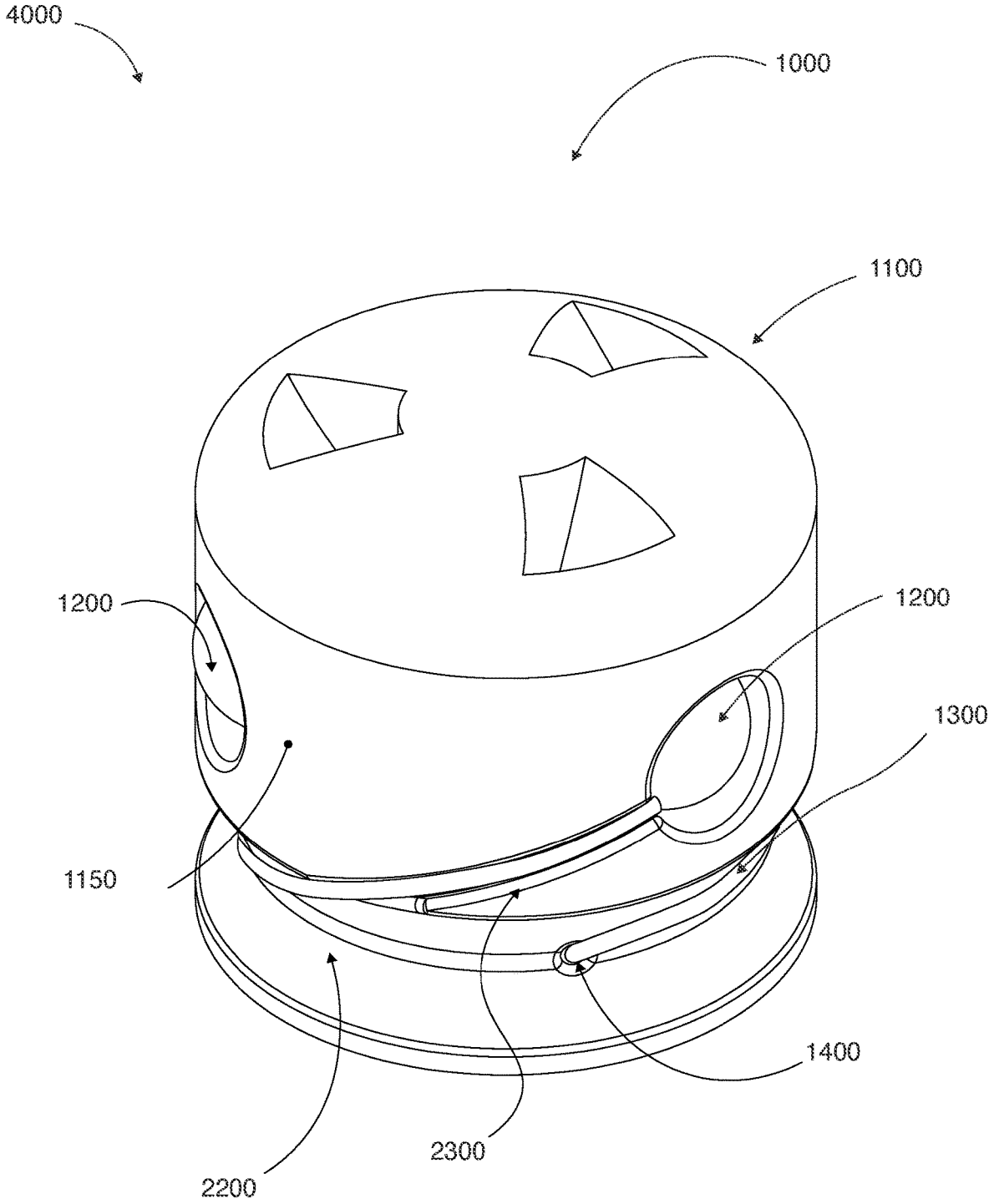
Figure 9:
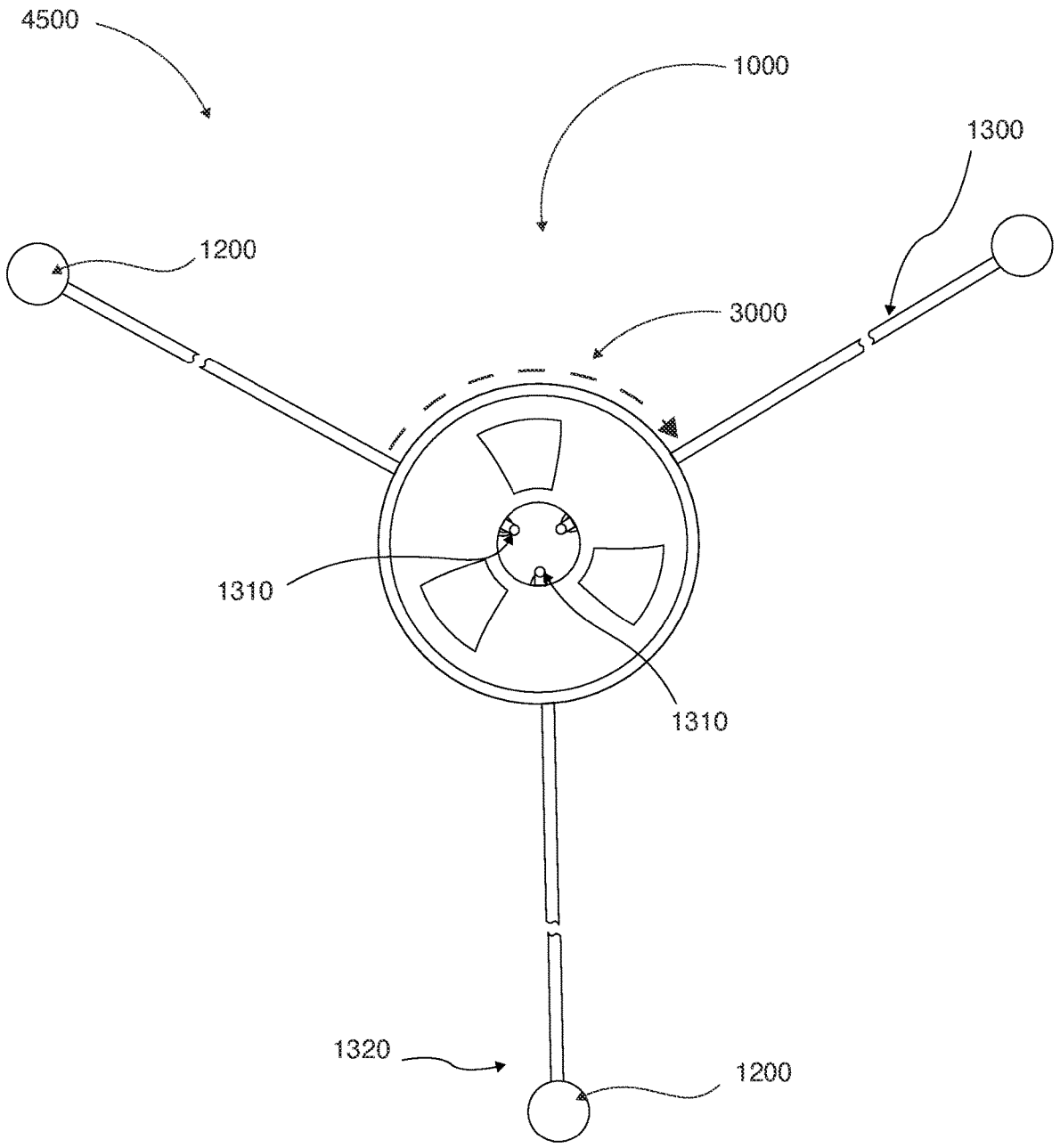

Certain embodiments of an entangling projectile system 1000, as shown in FIG. 5A-FIG. 6B and FIG. 8, comprise a central projectile 1100 having a plurality of satellite projectiles 1200 attached thereto with flexible line 1300. The flexible line 1300 is configured to be wound around the circumference of the central projectile 1100 when in a stowed configuration 4000 (as shown in FIG. 8) prior to firing, and is configured to unwind in flight to a deployed configuration 4500 (as Shown in FIG. 1 and FIG. 9) due to a spin induced to the central projectile 1100. The central projectile 1100 of certain embodiments comprises a first groove 2200 in an external surface 1150 of the central projectile. The first groove 2200 of certain embodiments comprises an annular shape and is located proximal to the rearward aspect 1130 of the central projectile. The first groove 2200 is offset rearward from the recesses 2000 and is configured to receive the flexible line 1300 as it is wound around the central projectile 1100.

In certain embodiments, shown in FIG. 4-FIG. 8, a central projectile 1100 comprises a second groove 2300 which interconnects a recess 2000 to the first groove 2200, allowing the flexible line 1300 to be placed therein to prevent the flexible line 1300 extending between the first groove 2200 and the recess 2000 from exceeding the maximum envelope 1160 of the central projectile. In certain embodiments the second groove 2300 extends from the recess 2000 to the first groove 2200 along a helical path around the longitudinal axis 1110 in the first rotational direction 3000. In certain embodiments, each recess 2000 comprises a second groove 2300 which interconnects it to the first groove 2200 wherein the second groove 2300 extends from the first groove 2200 to the recesses 2000 in the first rotational direction 3000. It will be appreciated that although second grooves are shown having a helical path in a rotational direction consistent with the rotational spin induced by aerodynamic channels, alternate embodiments wherein the aerodynamic channels are configured to induce a spin in a first rotational direction and second grooves which extend from the first groove toward the recesses having a helical path in a second rotational direction counter to the induced spin direction, are within the spirit and scope of the present invention.

In certain embodiments, as seen in FIG. 5A-FIG. 8, a central projectile 1100 comprises a plurality of apertures 1400 which extend through an external surface 1050 of the central projectile toward an inner aspect 1500 of the central projectile. In certain embodiments, the central projectile 1100 comprises a cavity 1600 which intersects the longitudinal axis of the central projectile.

In a stowed configuration 4000, shown in FIG. 8-FIG. 9, the flexible lines of satellite projectiles are passed through the plurality of apertures 1400, and into the cavity 1600 wherein the first ends 1310 of the flexible lines terminate. The first ends 1310 of the flexible lines are constrained within the cavity 1600 with the flexible lines 1300 extending through the plurality of apertures 1400. In a stowed configuration the flexible lines 1300 are wound around the central projectile 1100 within the first groove 2200, a distal portion of the flexible lines proximate to the second end 1320 of the flexible lines are placed within the second grooves 2300, and the satellite projectiles 1200 are placed within the recesses 2000.

In certain embodiments, as shown in FIG. 9 after firing, the spin induced to the central projectile 1100 in a first rotational direction 3000, creates a centrifugal action due to inertia which results in the satellite projectiles 1200 to release from the recesses and expand outward from the central projectile 1100, thus unwinding the flexible lines 1300 from the central projectile 1100. The flexible lines 1300 unwind until the flexible lines 1300 reach their extents transforming the entangling projectile system 1000 from a stowed configuration (FIG. 8) to a deployed configuration 4500.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A projectile system comprising:

a central projectile, and a first satellite projectile tethered to the central projectile with a first flexible line, wherein the first end of the flexible line is constrained by the central projectile, and the second end of the flexible line is interconnected to the satellite projectile;

the central projectile comprises a longitudinal axis extending from a forward aspect of the central projectile toward a rearward aspect of the central projectile, wherein the longitudinal axis is parallel with an intended direction of travel of the central projectile; and a first aerodynamic feature, wherein the first aerodynamic feature is configured to induce rotation of the central projectile in a first rotational direction after firing, wherein the projectile system is configured to be fired from a barreled weapon, wherein the projectile system is configured to be in a stowed configuration prior to firing wherein the first satellite projectile is held proximal to the central projectile, and wherein the projectile system is configured to transition to a deployed configuration after firing, wherein the central projectile rotates around the longitudinal axis and centrifugal action causes the first satellite projectile to expand radially away from the central projectile.

2. The projectile system of claim 1, wherein the central projectile further comprises a first recess in an external surface of the central projectile;

the first recess is configured to receive the satellite projectile therein, wherein the first satellite projectile is disposed within the first recess when in the stowed configuration, and wherein the first satellite projectile releases from the first recess in the deployed configuration.

3. The projectile system of claim 2, wherein the external surface of the central projectile comprises a circumferential surface.

4. The projectile system of claim 3, wherein the external surface of the central projectile comprises a cylindrical surface.

5. The projectile system of claim 3, further comprising a first groove extending from the first recess toward a rearward aspect of the central projectile, wherein the first groove is configured to receive the first flexible line therein.

6. The projectile system of claim 5, wherein the first groove extends toward the rearward aspect of the central projectile in a helical path.

7. The projectile system of claim 5, further comprising an annular groove in the external surface of the central projectile;

the annular groove is offset toward the rearward aspect of the central projectile from the recess; and the first groove extends between the first recess and the annular groove.

8. The projectile system of claim 7, further comprising an aperture extending from the annular groove in an inner aspect of the central projectile;

the aperture configured to receive the flexible line therethrough, wherein the first end of the flexible line is constrained within the inner aspect of the central projectile.

9. The projectile system of claim 8, further comprising:

a plurality of satellite projectiles, each tethered to the central projectile with a flexible line;

the central projectile comprising a recess for each of the plurality of satellite projectiles, wherein the recesses are angularly spaced around the central projectile;

a groove extending from each of the recesses toward the rearward aspect of the central projectile, wherein each of the grooves intersects the annular groove; and a plurality of apertures through the annular groove extending inward toward the inner aspect of the central projectile, wherein each of the flexible lines is inserted therethrough and the first ends of the flexible lines are constrained within the inner aspect of the central projectile, wherein the satellite projectiles are disposed within the recess when in the stowed configuration, and wherein the satellite projectiles release from the recess in the deployed configuration.

10. The projectile system of claim 9, wherein the recesses are angularly equidistantly spaced around the external surface of the central projectile.

11. The projectile system of claim 1, comprising a plurality of satellite projectiles tethered to the central projectile, wherein each of the plurality of satellite projectiles is tethered to the central projectile with a flexible line.

12. The projectile system of claim 11, wherein the flexible lines are wrapped around the central projectile in the stowed configuration, and wherein the flexible lines unwrap due to centrifugal action in a deployed configuration.

13. The projectile system of claim 12, wherein when in a stowed configuration, the flexible lines and satellite projectiles remain within a maximum envelope of the central projectile.

14. The projectile system of claim 13, wherein the maximum envelope comprises a cylindrical form.

15. The projectile system of claim 1, wherein the first aerodynamic feature comprises a channel.

16. The projectile system of claim 15, wherein the channel comprises a helical path around the longitudinal axis of the central projectile.

17. The projectile system of claim 16, wherein the channel extends from a medial portion offset from the longitudinal axis of the central projectile, and extends outward toward an external surface of the central projectile.

18. The projectile system of claim 17, wherein the channel extends through the external surface of the central projectile.

19. A projectile system comprising:

a central projectile, and a plurality of satellite projectiles each interconnected to the central projectile with a flexible line;

the flexible lines of the satellite projectiles each having a first end interconnected to the central projectile, and a second end interconnected to the satellite projectiles;

the central projectile comprising a longitudinal axis extending from a forward aspect of the central projectile to a rearward aspect of the central projectile, wherein the longitudinal axis is parallel with intended direction of travel of the central projectile;

a plurality of recesses in an external surface of the central projectile, wherein the recesses have the same shape as the satellite projectiles, wherein the recesses are each configured to receive one of the plurality of satellite projectiles therein;

a plurality of aerodynamic channels in the central projectile extending from the forward aspect of the central projectile toward the rearward aspect of the central projectiles, wherein the plurality of aerodynamic channels have a helical path around the longitudinal axis, the aerodynamic channels are configured to induce rotation of the central projectile in a first rotational direction;

a first groove in the external surface of the central projectile longitudinally offset from the recesses toward the rearward aspect;

a plurality of second grooves, wherein each of the second grooves extends from one of the first groove to the plurality of recesses helically in the first rotational direction; and a plurality of apertures extending through an outer aspect of the central projectile, extending from the first groove to a cavity in an inner aspect of the central projectile, wherein the plurality of apertures are configured to permit the sliding of the flexible lines therethrough, wherein the first ends of the flexible lines are within the cavity of the central projectile, wherein the flexible lines extend from the cavity through the apertures, and wherein the flexible lines extending through the apertures are wound in the first rotational direction around the central projectile within the first groove, and the satellite projectiles are disposed within the recesses.

* * * * *